US009657454B2

(12) United States Patent
Nottingham

(10) Patent No.: US 9,657,454 B2
(45) **Date of Patent: *May 23, 2017**

(54) EARTH RETAINING SYSTEM SUCH AS A SHEET PILE WALL WITH INTEGRAL SOIL ANCHORS

(71) Applicant: PND ENGINEERS, INC., Anchorage, AK (US)

(72) Inventor: William Dennis Nottingham, Anchorage, AK (US)

(73) Assignee: PND ENGINEERS, INC., Anchorage, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/588,580

(22) Filed: Jan. 2, 2015

(65) Prior Publication Data

US 2015/0354163 A1 Dec. 10, 2015

Related U.S. Application Data

(63) Continuation of application No. 12/348,431, filed on Jan. 5, 2009, now Pat. No. 8,950,981, which is a (Continued)

(51) Int. Cl.
*E02D 5/08* (2006.01)
*E02D 17/20* (2006.01)
(Continued)

(52) U.S. Cl.
CPC ..... *E02D 17/207* (2013.01); *E02D 5/02* (2013.01); *E02D 5/03* (2013.01); *E02D 5/04* (2013.01); *E02D 5/06* (2013.01); *E02D 5/08* (2013.01); *E02D 5/16* (2013.01); *E02D 5/54* (2013.01); *E02D 7/02* (2013.01); *E02D 29/02* (2013.01)

(58) Field of Classification Search
CPC ..... E02D 5/08
See application file for complete search history.

(56) References Cited

U.S. PATENT DOCUMENTS 912,661 A * 2/1909 Fiero ..... E02D 5/04 405/276
923,110 A 5/1909 Boardman
(Continued)

FOREIGN PATENT DOCUMENTS

JP 60-59228 * 5/1985
JP 2000192446 A 7/2000

*Primary Examiner* — Sunil Singh
(74) *Attorney, Agent, or Firm* — Perkins Coie LLP

(57) ABSTRACT

A soil retaining system combining flat sheet pile walls in an open cell configuration includes integral soil anchors providing an improved earth retaining system. Another aspect of the invention is a method of designing and installing a soil retaining system with an open sheet pile cell structure having integral soil anchors. The method includes, inter alia, calculating soil forces by taking into account material strength of sheet pile, soil friction against the sheet pile in combination with the strength of the integral soil anchor, selecting sheet pile size and length based on soil forces calculation; and installation of sheet pile to form a soil retaining system. The integral soil anchors serve to provide higher load resistance to the improved earth retaining system.

17 Claims, 8 Drawing Sheets

Related U.S. Application Data continuation of application No. 11/344,964, filed on Feb. 1, 2006, now Pat. No. 7,488,140, which is a continuation of application No. 10/801,123, filed on Mar. 15, 2004, now Pat. No. 7,018,141, which is a continuation of application No. 09/918,693, filed on Jul. 30, 2001, now Pat. No. 6,715,964.

(60) Provisional application No. 60/221,594, filed on Jul. 28, 2000.

(51) Int. Cl.

| | |
|---|---|
| ***E02D 5/03*** | (2006.01) |
| ***E02D 5/16*** | (2006.01) |
| ***E02D 5/54*** | (2006.01) |
| ***E02D 7/02*** | (2006.01) |
| ***E02D 5/06*** | (2006.01) |
| ***E02D 5/02*** | (2006.01) |
| ***E02D 5/04*** | (2006.01) |
| ***E02D 29/02*** | (2006.01) |

(56) References Cited

U.S. PATENT DOCUMENTS

| | | | | |
|---|---|---|---|---|
| 968,450 | A | | 8/1910 | Conkling et al. |
| 969,343 | A | | 9/1910 | Conkling |
| 1,005,514 | A | | 10/1911 | Conkling |
| 1,012,124 | A | | 12/1911 | Conkling |
| 1,032,109 | A | | 7/1912 | Buckingham |
| 1,067,489 | A | * | 7/1913 | Sederquist ..... E02D 5/04 405/278 |
| 1,071,985 | A | | 9/1913 | Conkling |
| 1,341,949 | A | | 6/1920 | Troye |
| 1,437,044 | A | | 11/1922 | Cushing et al. |
| 1,806,967 | A | | 5/1931 | Dougherty et al. |
| 1,834,744 | A | | 12/1931 | Schroeder |
| 1,896,259 | A | | 2/1933 | Thackray |
| 1,943,800 | A | | 1/1934 | Morrison |
| 1,951,292 | A | | 3/1934 | Cahill et al. |
| 1,951,293 | A | | 3/1934 | Cahill et al. |
| 2,004,188 | A | | 6/1935 | Borberg |
| 2,018,446 | A | | 10/1935 | Jensen |
| 2,057,947 | A | | 10/1936 | Hausler |
| 2,074,906 | A | | 3/1937 | Hausler |
| 2,128,012 | A | | 8/1938 | O'Rourke |
| 2,128,428 | A | * | 8/1938 | Murray, Jr. ..... E02D 5/04 405/278 |
| 2,909,901 | A | | 10/1959 | Suderow |
| 3,059,436 | A | | 10/1962 | Hermann, Jr. |
| 3,302,412 | A | | 2/1967 | Hunsucker |
| 3,613,382 | A | | 10/1971 | Dickinson |
| 3,751,930 | A | | 8/1973 | Mott et al. |
| 3,754,403 | A | | 8/1973 | Mott et al. |
| 3,797,258 | A | | 3/1974 | Dubuisson et al. |
| 3,822,557 | A | | 7/1974 | Frederick |
| 3,999,396 | A | | 12/1976 | Evans |
| 4,419,030 | A | | 12/1983 | Burkemper |
| 4,479,742 | A | | 10/1984 | Bruce |
| 4,486,125 | A | | 12/1984 | Reusswig |
| 4,511,288 | A | | 4/1985 | Wetmore |
| 4,579,481 | A | | 4/1986 | Gerwick et al. |
| 4,596,495 | A | | 6/1986 | Scharnell et al. |
| 4,618,286 | A | | 10/1986 | Michel et al. |
| 4,647,257 | A | | 3/1987 | Robishaw |
| 4,685,838 | A | | 8/1987 | Curt |
| 4,890,959 | A | | 1/1990 | Robishaw et al. |
| 5,213,447 | A | | 5/1993 | Srock |
| 5,292,207 | A | | 3/1994 | Scott |
| 5,520,487 | A | | 5/1996 | Decker |
| 6,234,720 | B1 | | 5/2001 | Queen et al. |
| 6,443,659 | B1 | | 9/2002 | Patout |
| 6,499,914 | B1 | | 12/2002 | Patout |
| 6,715,964 | B2 | | 4/2004 | Nottingham |
| 7,018,141 | B2 | | 3/2006 | Nottingham |
| 7,488,140 | B2 | | 2/2009 | Nottingham |
| 7,958,835 | B2 | | 6/2011 | Srinivasan |
| 8,444,348 | B2 | | 5/2013 | Braun et al. |
| 8,950,981 | B2 | | 2/2015 | Nottingham |
| 2007/0163186 | A1 | | 7/2007 | Baugh et al. |
| 2008/0286053 | A1 | | 11/2008 | Baugh et al. |
| 2009/0232607 | A1 | | 9/2009 | Nottingham |
| 2010/0143044 | A1 | | 6/2010 | Kadaster et al. |

* cited by examiner

EARTH RETAINING SYSTEM SUCH AS A SHEET PILE WALL WITH INTEGRAL SOIL ANCHORS

CROSS-REFERENCE TO RELATED APPLICATION

This application is a continuation of U.S. patent application Ser. No. 12/348,431, filed Jan. 5, 2009, which is a continuation of U.S. patent application Ser. No. 11/344,964, filed on Feb. 1, 2006, now U.S. Pat. No. 7,488,140 issued on Feb. 10, 2009, which is a continuation of U.S. patent application Ser. No. 10/801,123, filed Mar. 15, 2004, now U.S. Pat. No. 7,018,141 issued on Mar. 28, 2006, which is a continuation of U.S. patent application Ser. No. 09/918,693, filed on Jul. 30, 2001, now U.S. Pat. No. 6,715,964, which claims the benefit of U.S. Provisional Patent Application No. 60/221,594, filed Jul. 28, 2000. These applications are incorporated herein by reference in their entirety.

BACKGROUND OF THE INVENTION

Field of the Invention

This invention relates to an earth retaining system, and more particularly to a sheet pile retaining system having integral soil anchors.

Description of the Related Art

Marine related bulkheads constructed along the coast of Alaska experience some of the most severe environmental conditions known, including high waves and wave scour, earthquakes, ice, high tide variations, high phreatic water levels, weak soils, heavy live loads and difficult construction conditions. The need for low-cost, high load capacity docks and structures has resulted in a development of various sheet pile retaining structures.

Flat steel sheet piles have been used in perhaps the most simple form of structures featuring tension or membrane action primarily. Foundation designs of cellular cofferdams are discussed in detail in the text by Joseph E. Bowles, Foundation Analysis and Design (1977) herein incorporated in its entirety by reference. One configuration, a closed cell flat sheet pile structure, had been successfully used for many years for a wide variety of structures including cofferdams and docks. As shown in FIG. 1A, the most common use for flat sheet piles has been in closed cellular bulkhead structures of various geometrical arrangements. FIG. 1B illustrates another configuration, a diaphragm cell structure. By closing the cell structure, the entire structure acted as a deadman anchor in the retaining system to provide additional retaining support. However, positive structural aspects of this closed cell structure type were often offset by high construction costs. Several factors have contributed to higher costs, including: multiple templates required for construction alignment; close tolerances; difficulty with driving through obstacles and holding tolerance; backfilling operations using buckets or conveyors; and difficulty compacting the backfill. Modification of the closed cell to an open cell configuration provided higher accessibility and tolerance, but at a significant increase in material costs to offset the reduced load capacity of the cell configuration.

Yet another sheet pile retaining form has been the tied back wall masterpile system with flat sheet piles acting as a curved tension face. Tieback anchors with deadmen are connected to the curved tension face to provide lateral retaining strength as shown in FIG. 1C. This configuration allowed a higher load to be retained with fewer sheet piles used as the anchors and the sheets work in concert to retain the earth load. Tied back sheet pile walls often require deep toe embedment for lateral strength and if that toe embedment is removed for any number of reasons, wall failure will result. This method further required excavation for placement of the soil anchors, or an expensive and time consuming drilling operation to install the soil anchors, at the appropriate depth to integrate them with the sheet pile wall. Additionally, tied back walls are at risk in environments where waves overtop the wall and result in scour. Scour undermines the base of the bulkhead and the needed toe support resulting in failure of the bulkhead.

BRIEF SUMMARY OF THE INVENTION

The present invention overcomes the limitations of the prior art and provides additional benefits. Under one aspect of the invention, a soil retaining system combining flat sheet pile walls in an open cell configuration with soil anchors integral to the sheet pile provides an improved earth retaining system. In one embodiment of the invention, the integral soil anchors are angular interlock soil bearing surfaces which provide higher load resistance. Another aspect of the invention is a method of designing and installing a soil retaining system with an open sheet pile cell structure having integral soil anchors. The method includes, inter alia, calculating soil resistance by taking into account soil friction against the sheet pile in combination with the strength of the integral soil anchor, selecting sheet pile size and length based on these calculations; and installation of sheet pile to form a soil retaining system.

DETAILED DESCRIPTION OF THE INVENTION

A soil retaining system, and in particular, an apparatus and corresponding method for design and installation of an open cell sheet pile retaining wall having integral soil anchors is described in detail herein. In the following description, numerous specific details are provided, such as specific sheet pile configurations and interlock details as well as material selection, to provide a thorough understanding of embodiments of the invention. One skilled in the relevant art, however, will recognize that the invention can be practiced without one or more of the specific details. In other instances, well-known structures or operations are not shown or not described in detail to avoid obscuring aspects of the invention.

Figure 1A:
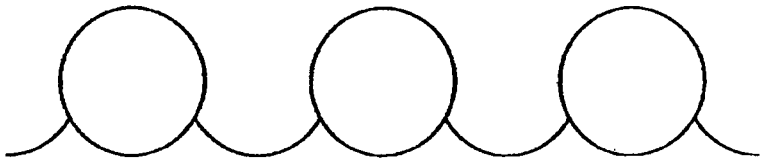
Fig. 1A (Prior Art)
FIGS. 1A-1C are plan views illustrating existing sheet pile wall configurations in accordance with the prior art.
Figure 1B:
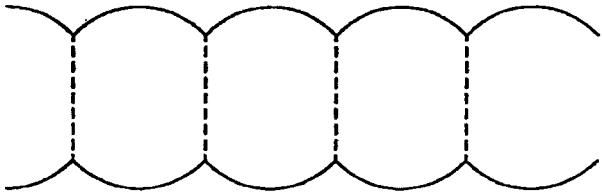
Fig. 1B (Prior Art)
Figure 1C:
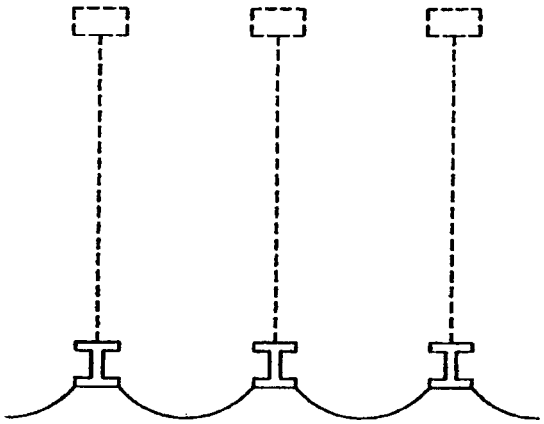
Fig. 1C (Prior Art)
Figure 2:
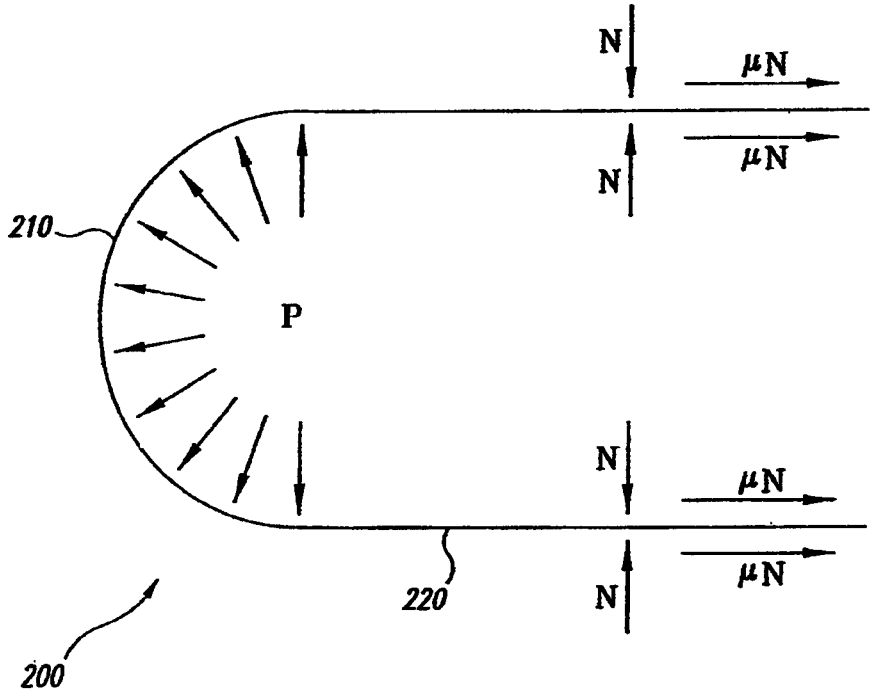
FIG. 2 is a plan view of theoretical forces on a sheet pile wall in accordance with the prior art.

FIG. 2 illustrates a typical open cell sheet pile structure 200. The cell 200 is typically constructed of vertical, flat sheet pile walls 210. FIG. 2 illustrates an exemplary configuration for a sheet pile wall, namely, a "U" shaped configuration. Each "U" shaped configuration forms a cell. The closed loop of the "U" is the front face of the wall and may be exposed on one side. The legs of the "U" are typically not exposed except on an end cell. The legs of the "U" are typically referred to as tail walls 220.

Open cell structures gain strength from the portion of the sheet pile buried in the soil fill. As illustrated in FIG. 2, the soil contained within the open cell structure and any load placed atop that soil, namely the dead and the live load, exert a pressure P on the face of the structure. The weight of soil fill surrounding the tail walls 220 presses against sheet pile surfaces with enough force N to keep tail walls from being pulled out. Under traditional soil analysis, the theoretical soil friction resistance is based on an assumed soil failure plane μN that is assumed to be parallel to the sheet pile wall facing as shown in FIG. 2.

In the present invention, a soil anchor integral with the sheet pile is designed to provide increased pull-out resistance and therefore yields a higher ultimate tension force. This higher ultimate tension force or effective overburden pressure yields a stronger retaining wall. Increased strength allowed fewer materials to be used and a more cost efficient wall to be built. These modifications of the typical closed cell to an open cellular shape with integral soil anchors serve to solve the problems associated with the closed cell configuration.

Figure 3:
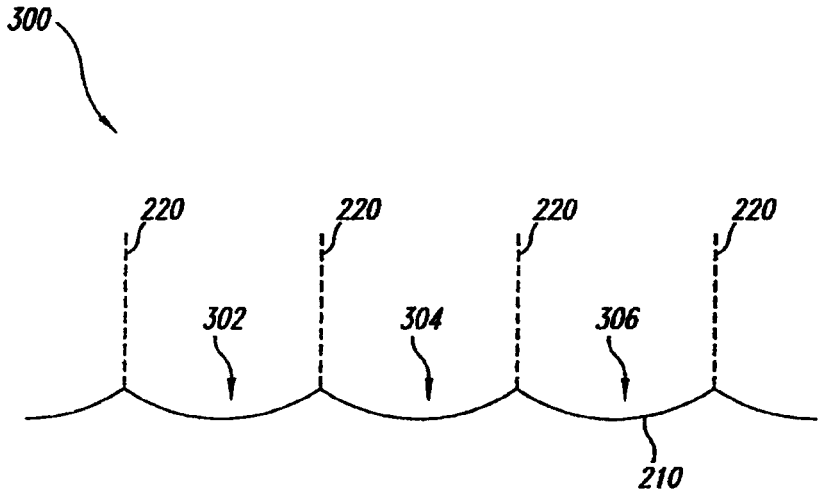
FIG. 3 is a plan view of an open cell sheet pile wall in accordance with principles of the present invention.

FIG. 3, illustrates a plurality of open cell structures connected together to form an open cell sheet pile retaining system 300. The open cell system 300 configuration is a first cellular structure 302 connected to and sharing a tail wall 220 with an adjacent second open cell structure 304. A third adjacent open cell structure 306 shares a tail wall 220 with the second open cell 304. The sheet pile tail walls 220 connects to a curved sheet pile cell face 210. The tail walls 220 act as anchors for curved sheet pile cell faces 210.

Operations and material cost savings are a significant improvement of the present invention over the prior art. By not closing the cell and by leaving the tail walls unconnected at the landward side, significant cost savings are realized from lower materials cost, increased construction tolerance and adjustment capability, and easier backfilling and compacting operations. Further, integral soil anchors in the sheet pile provide increased load resistance and allow shorter lengths of sheets to be used or lighter weight sheet pile materials to be used. The increased load resistance can result in a shorter depth of sheet penetration or a shorter overall length of tail wall to be used depending on the soil design characteristics. Open cell sheet pile structure construction can be used for various structures including oil containment, erosion control, docks in severe ice, wave or seismic environments.

Figure 4:
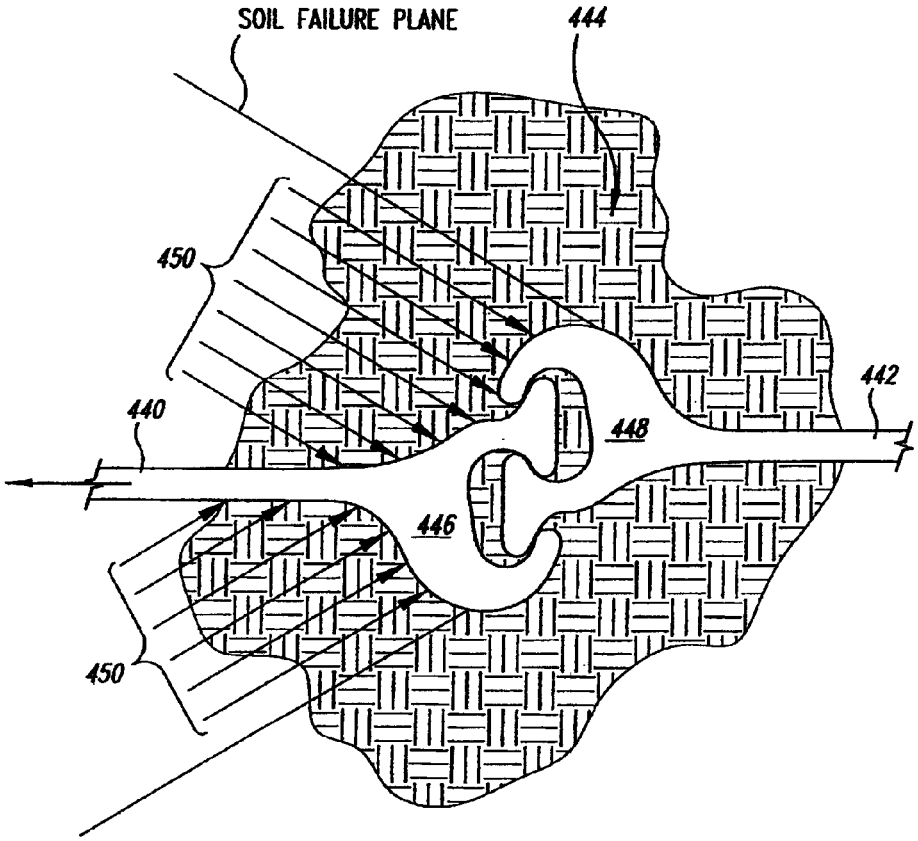
FIG. 4 is a cross sectional view along line 4-4 shown in FIG. 4 of forces on a sheet pile wall in accordance with principles of the present invention.

FIG. 4 illustrates one embodiment of an integral soil anchor. A first sheet 440 connected to a second sheet 442 via a soil anchor 444 that includes a first interlock 446 at one end of the first sheet 440 mated to a second interlock 448 at on end of the second sheet 442. Force lines 450 illustrate angled soil resistant anchor forces. The sheets 440, 442 provide soil friction resistance normal to the sheets while the soil anchor 444 provides bearing and pull-out resistance at an angle greater than normal shown by force lines 450.

Figure 5A:
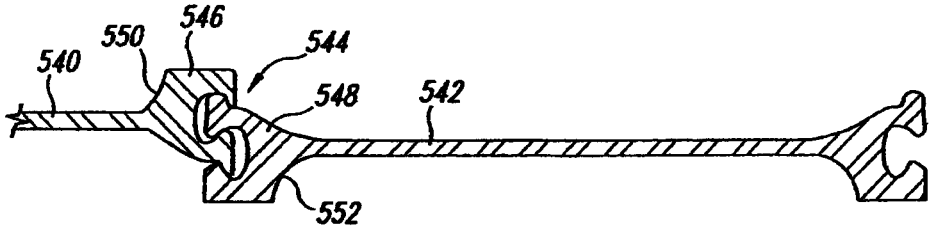
FIGS. 5A-G are cross-sectional views of additional embodiments of a first sheet pile connected to a second sheet pile illustrating integral soil anchors in accordance with principles of the present invention.
Figure 5B:
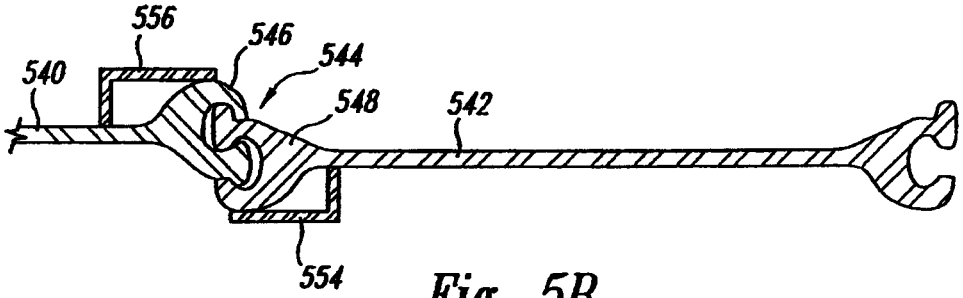
Figure 5C:
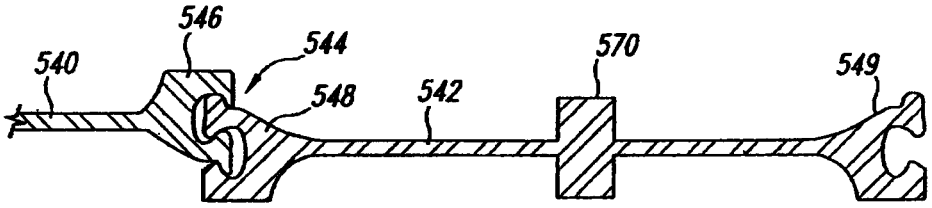

The greater the size of the soil anchor the greater the resistance. A preferable soil anchor width is greater than ½" and a more preferable soil anchor width is 3" to an effective over burden pressure or greater and a most preferable soil anchor width is 4" or greater as shown in FIGS. 5A-C. This configuration provides a combination that is an improved soil retaining system of greater strength than traditional sheet pile retaining walls.

FIG. 5A illustrates another embodiment of an integral soil anchor. A first sheet 540 is connected to a second sheet 542 via connection means 546, 548. The connection includes a first connection means 546 coupled to a second connection means 548. The connection means 546, 548 are shown integral to the sheets 540, 542, but may be affixed to the sheets such as in the rolling process by any mechanical means such as welding, bolting or other generally known attachment devices. The novel soil anchor of the present embodiment may be integral to the connection means wherein the sheet, connection means and soil anchor are formed simultaneously, or may be individually assembled components. A soil anchor 550, 552 is integral to the coupling means 546, 548. The soil anchor 550, 552 is shown as a squared off, corner of the coupling means 546, 548. The shape of the soil anchor is relevant to the increased resistance to force. A square shape has been shown in testing to resist higher forces than a round or angled shape. The square shape provides a greater bearing resistance against the soil.

FIG. 5B illustrates yet another embodiment of the present invention wherein the integral soil anchor, 554, 556 is an "L" bracket affixed to an exterior side of the first and/or second connection means 546, 548 at one end of the L and to the web of the sheet 540, 542 at the other end of the L.

This soil anchor may be affixed subsequent to the rolling or manufacturing of the sheet pile.

FIG. 5C illustrates yet another embodiment of the present invention wherein the integral soil anchor is positioned other than at the intersection of two sheets. An intermediate integral anchor 570 is positioned between connection means 548, 549 on the second sheet 542. The intermediate anchor 550 is shown as a solid block incorporated into the sheet 542 itself. Alternatively, the integral anchor 550 may be any geometric configuration and may be adhered to either an inside or an outside face of the sheet or both, or may be an integral composite component of the sheet.

Figure 5D:
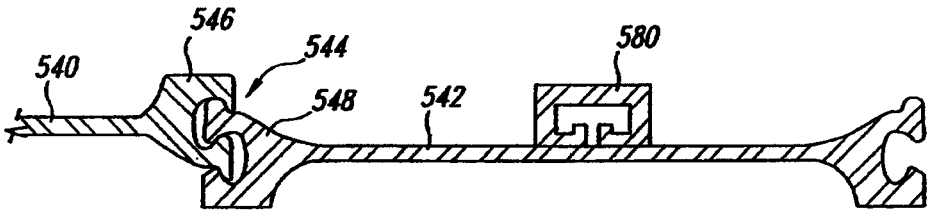
Figure 5E:
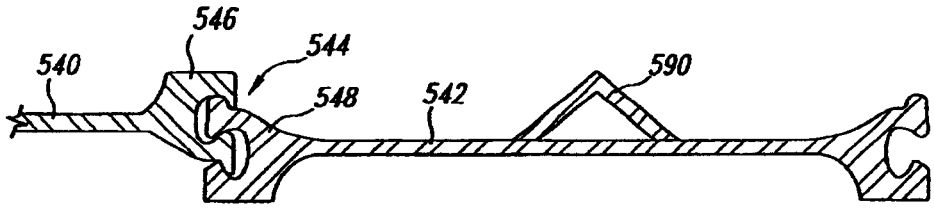

FIG. 5D illustrates another embodiment of the intermediate integral soil anchor. The intermediate soil anchor 580 is a "C" shaped angle welded or otherwise affixed to the exterior of the sheet 542. FIG. 5E illustrates an intermediate integral soil anchor 590 that is an "L" bracket affixed to a face of the sheet 542.

The greater the size of the soil anchor the greater the resistance. A preferable soil anchor width is greater than ½" and a more preferable soil anchor width is 3" to an effective over burden pressure or greater and a most preferable soil anchor width is 4" or greater as shown in FIGS. 5A-C. This configuration provides a combination that is an improved soil retaining system of greater strength than traditional sheet pile retaining walls.

Figure 5F:
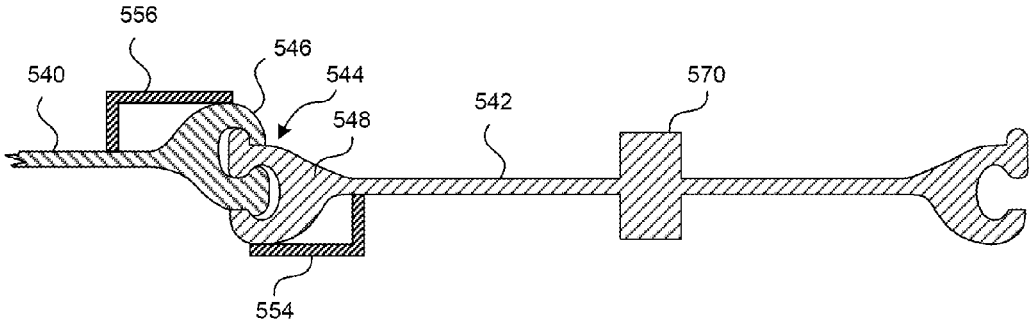
Figure 5G:
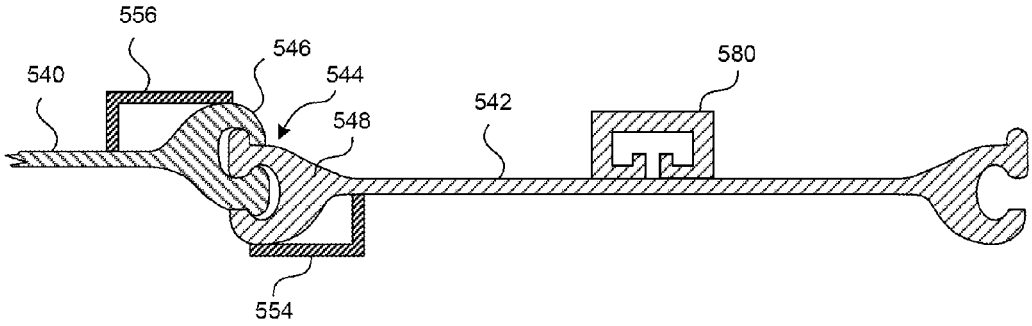

Any variety of geometric shapes could be used to form the integral soil anchor. Further, the soil anchors may be positioned at any point along the sheet pile wall including at a connection point between adjacent sheet pile walls. Intermediate integral soil anchors may be combined with integral soil anchors at the connection point as shown, for example, in FIGS. 5F and 5G. FIG. 5F illustrates the intermediate soil anchor 570 that protrudes through sheet 542. The embodiment illustrated in FIG. 5F also has integral soil anchors 554, 556 that are "L" brackets affixed to the connection means 546, 548. FIG. 5G illustrates the intermediate soil anchor 580 that is a "C" shaped angle welded or otherwise affixed to the exterior of the sheet 542. The "L" brackets are affixed to the connection means 546, 548. Alternatively, intermediate integral soil anchors may be used independently. Furthermore, multiple intermediate integral soil anchors may be positioned on a single sheet pile.

The integral soil anchors may extend the full height of the wall or may extend down the sheet pile wall some distance less than full height. Further, the integral soil anchors may be placed vertically on the sheet pile wall or may be placed at an angle. Length and positioning of soil anchors integral to the sheet pile wall is dependent on various design load parameters.

The soil anchors 544, 550, 552, 554 shown in FIG. 5A-D have angular configurations to provide a greater soil resistant anchor force. Increase in the size of the soil anchor shape has been shown to increase the soil resistant anchor force linearly. The soil anchor resists forces by acting as microanchors or deadman. The soil anchor shape effects anchor resistance by a factor of up to cos 45°. A variety of soil anchor shapes, for example, round, angular, blocks, triangular or hexagonal may be used. Testing has shown that square shapes yield a greater resistance than alternative shapes.

The main structural components of open-cell construction are accomplished without the use of field welding, bolted connections, or an independent tieback system because the soil anchor is integral to the sheet piles of the retaining wall. Additionally, open-cell construction does not require sheet pile cell closure and allows for easy backfilling, since the cell is open in the back. This combination structure has the ability to resist large loads from ice and vehicles, and are highly insensitive to erosion conditions when compared with conventional sheet pile walls. The dock face can further be modified to include face ladders, mooring systems, fender systems, and varying access elevations. These features reduce costs and time required for construction. Construction costs for open-cell structures are therefore less than for other dock or bulkhead types.

Many problems are encountered in sheet pile construction and during the life of the retaining wall. An open cell sheet pile wall with integral soil anchors is a versatile retaining system that overcomes many of these problems.

One example of a design consideration to overcome is waves. Waves will produce forces on walls, but the most critical factor is wave overtopping. Open cells can withstand wave overtopping, with damage being limited to minimal loss of backfill. Further, just as river scour occurs around bridge piers, the forces from waves and associated currents cause scour at the base of impacted bulkheads. Tied back or cantilever sheet pile structures have a significant problem with any type scour because of loss of needed toe ground support. Conversely, the open cell structure with integral soil anchors is designed independent from exterior soil support, thus, scour can progress nearly to the cell bottom without any serious consequence.

Another design consideration is phreatic water. Phreatic water refers to water levels within bulkhead fill such as from tidal action which lags or leads tide levels. Very large forces from hydraulic head can be developed on bulkhead structures. Attempts to reduce this action by use of weep holes have not been totally successful because of possible drainage channel plugging and oxygenated corrosive water introduction into backfill. Open cell structures with integral soil anchors are readily designed to handle phreatic water and the associated forces without elaborate drainage or internal cell corrosion control measures.

Along with phreatic water levels, bulkhead stability is usually controlled by seismic forces. Analysis often follows classic wedge or slip circle theory that tests the overall mass stability. Open cell anchor wall resistance outside of failure planes is used to provide bulkhead stability safety factors, an important feature of this type structure. If design conditions warrant, an end anchor such as a large "H" pile may be added as an additional safety factor.

Open cell structures with integral soil anchors may be built in ice environments where ice thickness can reach one to two meters without damage to the structure. One explanation for this and a factor in design is strength of frozen bulkhead fill. As ice growth develops on water bodies, depth of frost in granular open cell backfill will often surpass the level of ice. Since frozen ground is usually stronger than ice, a naturally reinforced structure is created. Rubble ice formation early in the season, although usually impressive, is usually not a severe loading for open cells. As with seismic design, mass stability of bulkheads subject to large lateral ice loads is important.

Open cell tail wall extension having integral soil anchors can often effectively spread out dead and live loads if weak soils are encountered. Concern with such conditions is structure settlement. Flexibility of open cell wall structures with integral soil anchors readily handle unusual deformation.

The nature of large live loads, such as from cranes, cargo, stored containers, forklifts and heavy equipment is ideally suited to open cells with integral soil anchors because compacted earth fill provides sound support and the resistance nature of tail walls with integral soil anchors actually increases from such loads.

Wall heights of about 3 meters—20 meters are easily retainable for open cell construction with integral soil anchors, although longer or shorter sheets may be used. However, practical limitations are present, for example, longer sheets are difficult to handle and drive and are therefore less preferred. Cell width is preferably about 10 meters, but can be varied to account for end conditions and low wall height transitions. Tail wall lengths vary significantly subject a wide number of design parameters.

Sheet pile construction involves driving sheets a distance below the ground surface, which by its very nature, can be difficult. If very deep driving is required, difficulty can almost always be expected. Open cell structures with integral soil anchors of the present invention do not require deep embedment for stability due to the increased soil resistance provided by the integral soil anchors, and as a result are easier to construct and have redundancy for unusual conditions such as toe scour, toe liquification or overloads. Additionally, sheets of the present invention may be driven with fast vibratory hammers. Alternatively, open-cell structures with integral soil anchors may include deep embedment for additional stability.

Usually a one level template is adequate for open cell construction and wall tolerance is maintained by close attention to position and plumbness of "wye" shapes at intersections. Attention to wye position are carried through backfill operations which consists of controlled compacted layer construction. Cells are usually filled from the land using trucks, the result being the least costly method.

Figure 6:
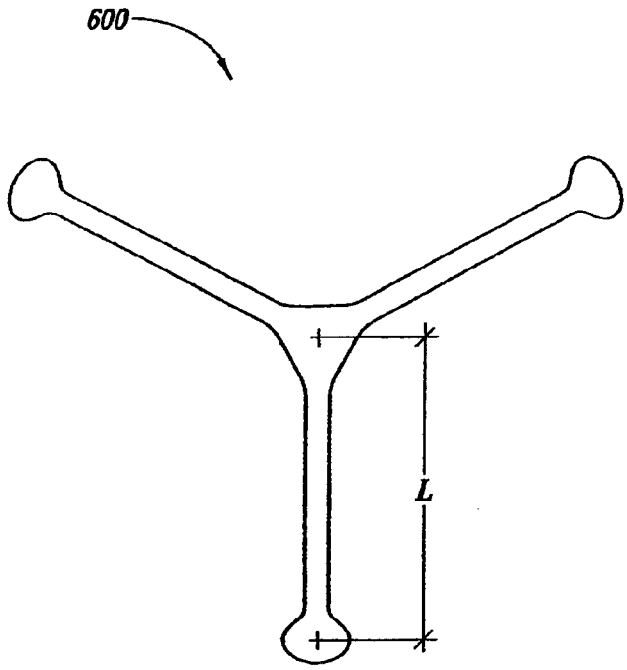
FIG. 6 is a cross-sectional view of a wye or anchor in accordance with principles of the present invention.

FIG. 6 illustrates one embodiment of a wye configuration that may be used in the present invention. The wye 600 may be used to couple a face sheet of a first cell to a face sheet of a second cell to the shared tail wall of the two cells.

Tail wall driving tolerance can be large and tail walls may be curved around obstructions. By dead ending tail walls, no close tolerance connections are required such as with closed cells. Flexibility in the position and driving tolerance of tail walls yields a significant cost savings. The cost effectiveness of this feature cannot be overemphasized.

There are numerous advantages and uses for open cell bulkheads with integral soil anchors. Higher soil resistance to pull-out forces from the integral soil anchors allow shorter tail walls to be used. This results in lower transportation and material procurement costs. Further, time and cost savings are realized because the cell is faster to construct. Furthermore, the open cell dock presents a pleasing scalloped appearance from the water side, and a neat uniform flat appearance from topside.

Open cells further include health and cleanliness advantages. An open cell dock consists of solid earth fill, providing no access under the dock for nesting disease-carrying rats and vermin common to platform-type docks. The elimination of this health risk is particularly important around food processing plants. In areas previously subjected to use, construction of the new dock encapsulates debris and hazardous materials existing on the sea floor behind the sheet pile wall and within the fill. Additionally, the open cell dock offers no space below the dock for the collection of future debris junk, and drift. Furthermore, open cell dock surfaces can be sloped away from the water so that oil and wastes, if spilled, drain away from the water-side of the dock. If not cleaned up directly, a spill could seep into the fill where it would be contained against seeping into nearby waters by the surrounding sheet pile wall.

Yet another advantage of the present invention is with respect to the protection of utilities. Utilities and fuel lines can be buried by conventional methods in the fill, where they are protected from freezing and from vehicle and vessel impact. If utility leakage should occur, any spillage is contained in the fill. Damaged utilities are readily accessible for repair. These are great advantages over conventional docks, where utilities are normally suspended under the deck or run along surfaces.

Runoff water can be kept from draining directly into marine waters. Instead, runoff may be either collected in a drain system, or seeped into the fill where it must travel long distances through filtering fill before it enters marine waters.

The present invention is adapted well to marine habitats. The protected area between fender piles and the scalloped faces of sheet pile cells can serve as a refuge for marine life. In addition, sheet pile faces and fender pile surfaces provide clean hard surfaces where anemones, urchins, and mollusks can attach themselves. Special hanging chain fish habitats have also been devised along structure faces.

Very little maintenance is required once the present system is in place. Open cell docks of the present invention consist of essentially two materials, earth fill and sheet piles with integral soil anchors. Earth fill, properly contained behind a bulkhead, and sheet piles, if properly protected against corrosion, are virtually maintenance free. There is no need for riprap under the dock, as with pile-supported docks. Riprap under pile-supported docks often subsides or can be wave-displaced over time, and may become a difficult and expensive maintenance item.

Properly constructed, the open cell dock with integral soil anchors is capable of supporting huge loads such as large cranes, heavy forklifts and heavy storage loads, without danger of collapse. Furthermore, the steel cells which are filled with earth and rock have tremendous resistance to damage by ice pans, vessel impact, and other drift forces. There are no weak elements such as vertical bearing piles, pile caps, or waters to be damaged by drift forces. Additionally, mooring devices on open cell docks have exceptionally high capacity because they are tied to the large deadweight of the dock. The components of open cell docks, earth and sheet piles, are extremely fire resistant. In addition, the dock can be used to provide a safe platform from which fire fighters could combat fires occurring on nearby boats or in waterfront buildings.

The present system is very cost effective as compared to conventional building systems. Open cell docks having integral soil anchors typically may be built for about half the cost of a heavy-duty pile-supported dock based on an "area created" basis. Furthermore, one of the two primary dock materials, earthfill can usually be obtained locally at minimal cost.

Ease of construction of the present invention allows cost savings in both time and materials. Open cell docks having integral soil anchors can be constructed entirely from the land. This eliminates the need for cumbersome barge-based construction and related oil spill hazards. Construction is so repetitive that local labor forces, inexperienced with pile driving or dock construction, have built them. Fill can be end-dumped into place since the rear side of each cell is open. Little siltation results from this construction method. No detail work such as installation of traditional walers and tiebacks is required in the tidal zone.

Yet another advantage of the present invention is that minimal embedment of sheets is required along the front face of the dock below the existing ocean bottom. This makes the open cell dock having integral soil anchors particularly attractive where bedrock is at or near the surface. Drilling and/or blasting for rock anchors or embedment would be required for other types of docks in this situation, with resulting environmental disruption. Furthermore, the open cell concept creates flat land both at the new dock and at the borrow source. If the borrow source is a hill immediately behind the dock, then valuable staging area is created. The economics of an open cell dock project look even better if the value of this additional staging area is factored in the cost.

Figure 7:
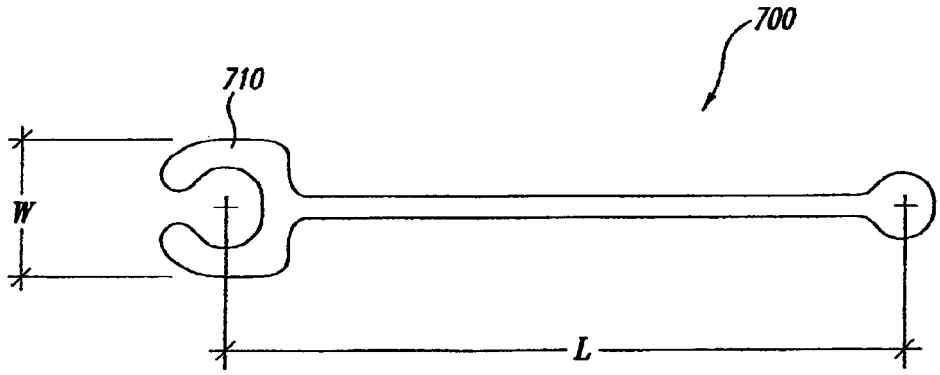
FIG. 7 is a cross-sectional view of yet another embodiment of the present invention illustrating a composite material sheet pile in accordance with principles of the present invention.

FIG. 7 illustrates yet another embodiment of the present invention. The sheet 700 of FIG. 7 is of a shorter horizontal length L than a typical sheet and may be constructed of a composite material. Furthermore, the connection means 710 may be of a width W greater than conventional connection means. A preferable W of the connection means or soil anchor is 4" or more. The coupling means 710 of this embodiment is shown as a block for illustrative purposes. The size of the coupling means may be increased as needed for the given design considerations to increase to soil resistance of the integral anchor.

Composite material used to construct the sheet may, for example, include formed plastics, extruded plastics, composite metal and plastic, fiberglass, carbon fibers, aluminum and the like. Composite materials have the additional advantage of flexibility of design of the coupling means.

Figure 8:
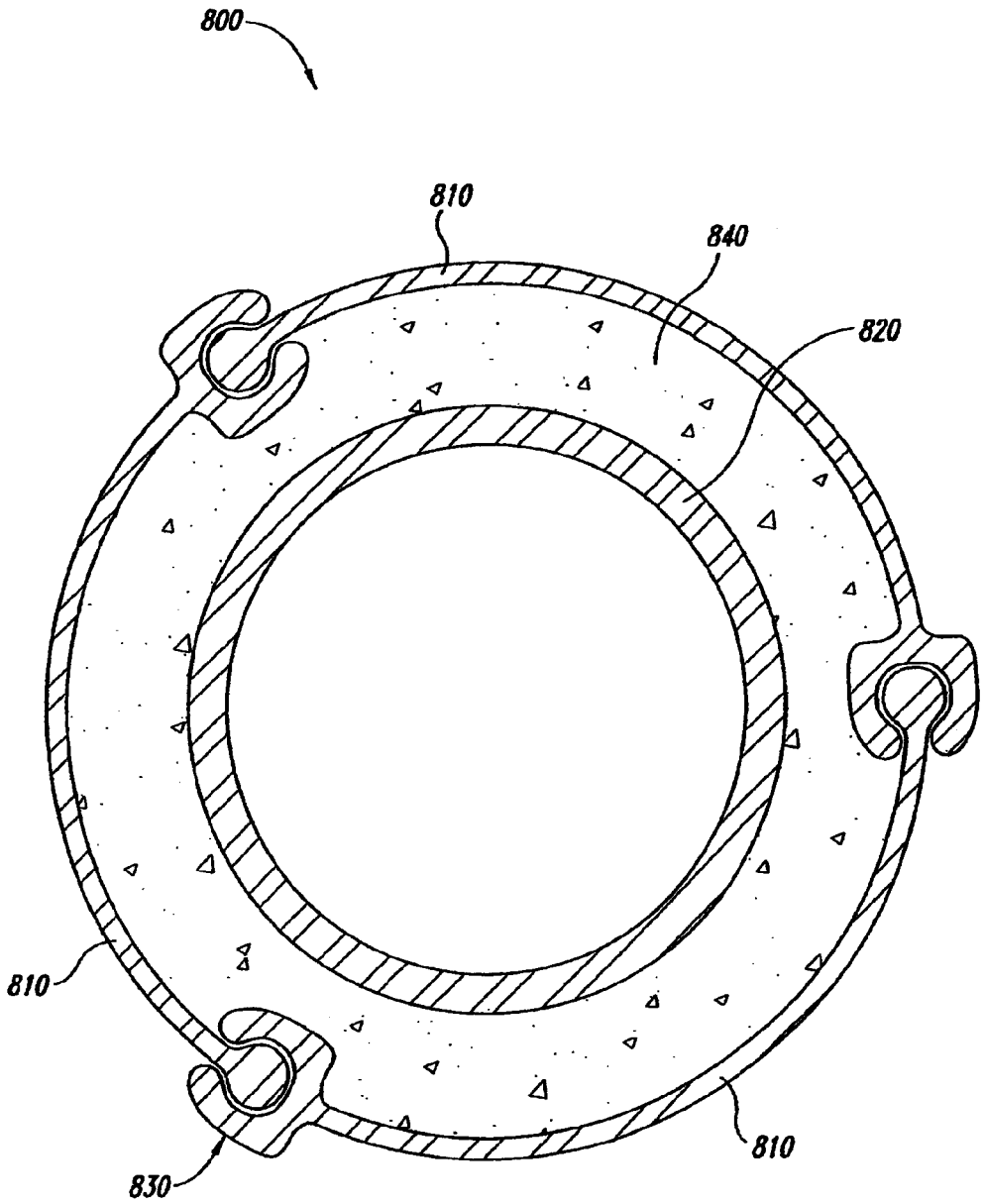
FIG. 8 is a cross-sectional view of an alternative embodiment illustrating a cell configuration in accordance with principles of the present invention.

FIG. 8 illustrates a specialized use of the composite sheets and yet another embodiment of the present invention illustrating a sleeved pile repair 800 of an existing pipe pile 820. Special sheet piles 810 can be formed or bent to accomplish a number of tasks, including sleeved pile repair, column forming, conduits and covers. The connection means 830 can easily be slipped together to instantly form a variety of shapes for many uses. Concrete, grout or other materials 840 can be used to fill any annulus created thus creating a structural section.

An improved soil retaining system including an open cell design including integral soil anchors has lead to a versatile structure capable of wide adaptation. Resolution of not only design, but also construction problems has further reduced cost of these structures and created another tool for developing an economical solution.

The following failure testing example is provided as an illustration.

EXAMPLE 1

Testing by: D. Nottingham
C. Canfield

Apparatus: A test box 2'×2'×4" high to hold sand was constructed of plywood and pressed board.

Materials: Silica sand in the sand of #30 to #70 sieve was obtained.

Two end sections of PS32 sheet piles were cut to about 3" height.

Test Procedure: The silica sand was dampened and packed around the sheet pile sections. A wire was run through a hole in the box to one end of the sheets, and connected.

The assembly was pulled into the sand until stress cracks formed in the sand. The test was photographed and observed as to nature and direction cracks. Test was repeated numerous times.

Results: Cracks in sand did not form parallel to sheet pile sides, but did so at about 30 degree±angles emanating from sheet pile interlocks. This was a result of the interlocks acting as an integral microanchor. Soil friction against sheet pile sides did not appear to be present at time of soil cracking. This testing verifies the theory that the interlock provides soil resistance in addition to the normal forces resisted by the sheets themselves.

Figure 9:
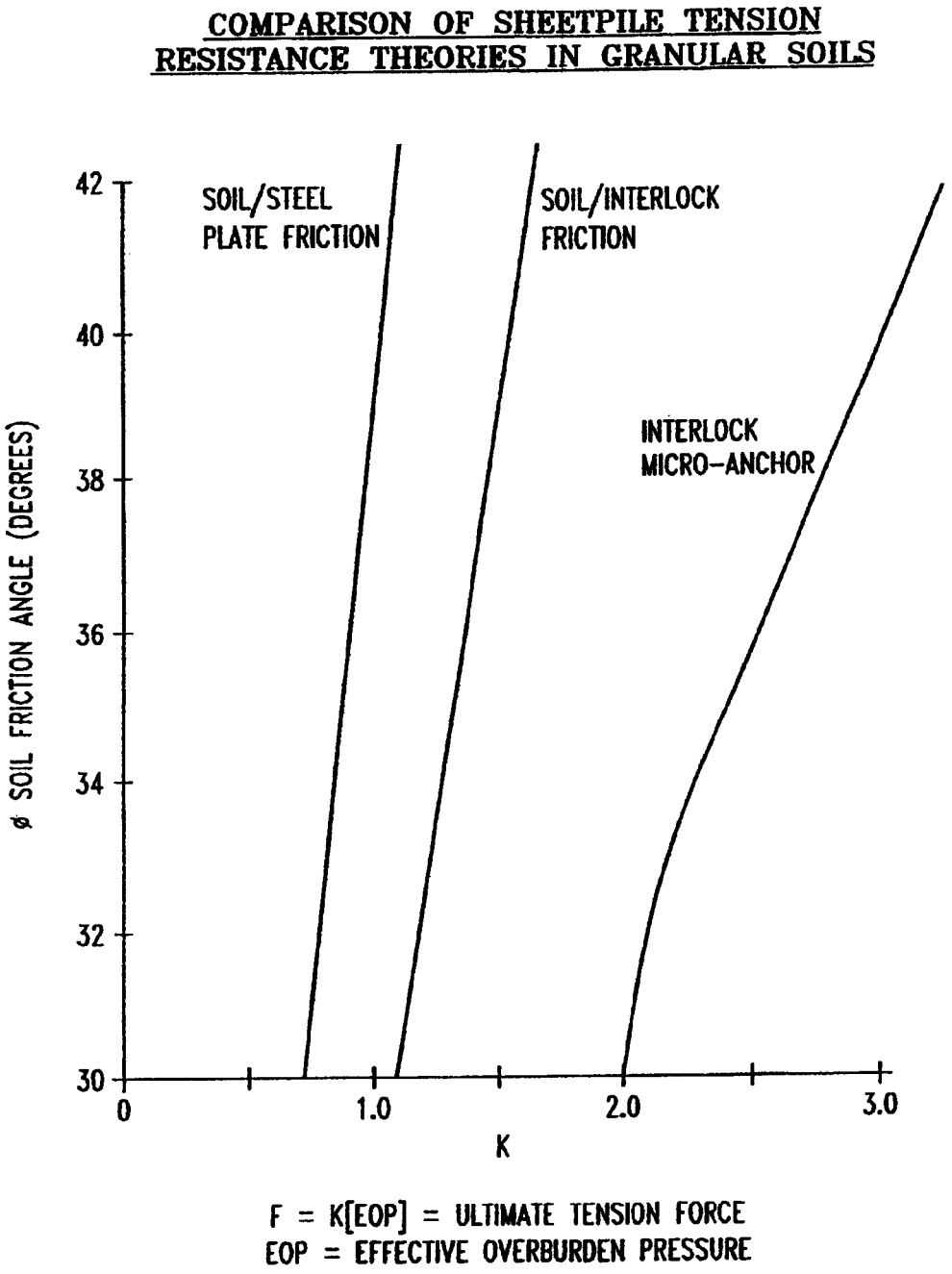
FIG. 9 is a graph of soil friction and ultimate tension force in accordance with principles of the present invention.

FIG. 9 illustrates a comparison of sheet pile tension resistance theories in granular soils in accordance with the above testing and in accordance with the principles of the present invention. As is shown from the graph the integral soil anchors provide greater resistance to soil forces, thus allowing lighter materials or shorter pile to resist the same forces as conventional retaining systems.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method for retaining soil using an open sheet pile cell structure comprising:

installing a face wall;

installing a tail wall, wherein installing the tail wall includes coupling a first sheet and an adjacent second sheet along their corresponding side edges using a connection means, wherein the first and second sheets each has generally longitudinal first and second side faces, wherein at least one of the first and second sheets has an integral soil anchor attached to the connection means, such that the integral soil anchor contacts soil and provides resistance to soil forces; and connecting the face wall with the tail wall, wherein at least one of the first and second sheets has an intermediate soil anchor extending a selected distance away from at least one of the first or second side faces of the sheet and integral therewith, such that the intermediate soil anchor contacts soil and provides resistance to the soil forces, and wherein the intermediate soil anchor is separate from the connection means.

2. The method of claim 1 wherein the intermediate soil anchor extends away from both the first side face and the second side face of at least one of the first and second sheets.

3. The method of claim 1 wherein the intermediate soil anchor extends continuously along the entire first side of at least one of the first and second sheets.

4. The method of claim 1 wherein the sheets and the intermediate soil anchor are formed of a composite material.

5. The method of claim 1 wherein a shape of the integral soil anchor is selected from a group consisting of round, angular, triangular, hexagonal and L shapes.

6. The method of claim 1 wherein the integral soil anchor increases a soil resistance of the corresponding sheet by a factor of up to cosine 45°.

7. The method of claim 1 wherein the tail wall is a first tail wall, the method further comprising:

installing a second tail wall having a plurality of sheets coupled along their side edges using a connection means, wherein the plurality of sheets of the second tail wall have generally longitudinal first and second side faces; and connecting the second tail wall with the face wall, wherein at least one of the sheets of the second tail wall has an intermediate soil anchor extending a selected distance away from at least one of the first or second side faces of the at least one sheet of the second tail wall and integral therewith, such that the intermediate soil anchor contacts soil and provides resistance to the soil forces.

8. A method for retaining soil using an open sheet pile cell structure comprising:

installing a face wall;

installing a tail wall, wherein installing the tail wall includes coupling a first connection means of a first sheet and a second connection means of an adjacent second sheet along their corresponding side edges, wherein at least one of the first and second sheets has an L-shaped integral soil anchor directly attached to its connection means and extending from a face of the sheet a selected distance, wherein the integral soil anchor is not used for the connection between the first sheet and the second sheet, and wherein the integral soil anchor contacts soil and provides resistance to soil forces; and connecting the face wall with the tail wall, wherein the integral soil anchor is a first protrusion, and wherein at least one of the first and second sheets has a second protrusion attached to the face of the at least one of the first and second sheets away from the first or second connection means.

9. The method of claim 8 wherein the second protrusion is selected from a group consisting of round, angular, triangular, hexagonal and L shapes.

10. The method of claim 8 wherein the tail wall is a first tail wall, the method further comprising:

installing a second tail wall comprising a plurality of sheets coupled along their side edges using a connection means, wherein at least one of the plurality of the sheets of the second tail wall has an integral soil anchor attached to corresponding connection means and extending from the face of the second tail wall sheet a selected distance; and connecting the second tail wall with the face wall.

11. The method of claim 8 wherein the integral soil anchor increases a soil resistance of the corresponding sheet by a factor of up to cosine 45°.

12. The method of claim 8 wherein the integral soil anchor extends away from both the first connection means of the first sheet and the second connection means of the second sheet.

13. The method of claim 8 wherein the integral soil anchor extends continuously along an entire first side of at least one of the first and second sheets.

14. A method for retaining soil using an open sheet pile cell structure comprising:

installing a first generally longitudinal sheet having a first side face and a second side face, a top and a bottom edge along the generally longitudinal direction, and a first and second side edges portion, wherein the edge portions have a first connection means for coupling the first sheet to adjacent sheets; and installing a second generally longitudinal sheet having a first side face and a second side face, a top and a bottom edge along the generally longitudinal direction, and a first and second side edges portion, wherein the edge portions have a second connection means for coupling the second sheet to the adjacent sheets, wherein at least one of the first and second longitudinal sheets has an intermediate soil anchor positioned on at least one of the first and second faces, and wherein the intermediate soil anchor contacts soil and provides resistance to soil forces;

wherein the first or the second connection means include an angular integral soil anchor measuring at least three inches in width when viewed in cross-sectional view, wherein the angular integral soil anchor extends along the full side edge of the first or the second sheets, and wherein the angular integral soil anchor increases the soil resistance of the first or the second sheet in-situ by a factor of up to cosine 45°.

15. The method of claim 14, further comprising:

installing a face wall; and coupling the first sheet with the face wall.

16. The method of claim 14 wherein the first and second sheets comprise a section of a first tail wall, the method further comprising:

installing a face wall;

installing a second tail wall; and coupling the first and second tail walls with the face wall, wherein sheets of the second tail wall have a second connection means, wherein the second connection means of at least one sheet of the second tail wall includes a second angular integral soil anchor measuring at least three inches in width when viewed in cross-sectional view, wherein the second angular integral soil anchor extends along the full side edge of the sheets of the second tail wall, and wherein the angular integral soil anchor increases the soil resistance of the first or second sheet in-situ by a factor of up to cosine 45°.

17. The method of claim 14 wherein the sheets and the integral soil anchor are formed of a composite material.

* * * * *